United States Patent [19]

Yale

[11] 4,210,250

[45] Jul. 1, 1980

[54] REVERSIBLE ENVELOPE

[76] Inventor: Robert S. Yale, 1660 Avon Pl. NW., Washington, D.C. 20007

[21] Appl. No.: 19,155

[22] Filed: Mar. 9, 1979

[51] Int. Cl.[2] ..... B65D 27/06; B65D 27/32

[52] U.S. Cl. ..... 206/632; 229/73

[58] Field of Search ..... 229/73; 206/632, 633

[56] References Cited

U.S. PATENT DOCUMENTS

| | | | |
|---|---|---|---|
| 895,520 | 8/1908 | Virkus | 229/73 |
| 1,228,146 | 5/1917 | Swift, Jr. | 229/71 |
| 3,558,040 | 1/1971 | Krueger | 229/73 |

*Primary Examiner*—Stephen P. Garbe

*Attorney, Agent, or Firm*—Bacon & Thomas

[57] ABSTRACT

An envelope blank has a main panel and end and side flaps foldable over the same face of the main panel and having releasable adhesive on the flaps to hold the envelope temporarily closed for a first mailing and additional, preferably permanent, adhesive on the flaps for holding the envelope securely closed for a second mailing. Both the releasable and permanent adhesives being on the same face of the blank, the flaps being foldable to overlie one face of the main panel for the first mailing and foldable to overlie the other face of the main panel for the second mailing.

7 Claims, 4 Drawing Figures

REVERSIBLE ENVELOPE

BACKGROUND OF THE INVENTION

The concept of providing an envelope that can be closed and mailed and one whereby the receiver may then open the envelope to remove its contents and use the same envelope for a return mailing is old and many attempts have been made to provide a satisfactory envelope capable of such use. It is desirable to be able to use the same envelope for return mailing to conserve paper, which becomes an expensive item where a great number of mailings are made from, for example, business establishments in billing their customers. It is further desirable that the first mailing be capable of being handled, that is, formed into an envelope, stuffed with an enclosure and closed for mailing, all by automatic machinery. It is further desirable that such mailings be capable of being reused for return to the sender.

The present invention is an improvement on the reversible envelope shown and claimed in my prior U.S. Pat. No. 4,089,419, issued May 16, 1978. That prior patent shows an envelope not subject to the objections discussed above, but wherein some adhesive material was applied to both sides of the blank from which the envelope was formed. The application of adhesive material to both sides of the envelope presents some problems in manufacture and handling.

SUMMARY OF THE INVENTION

The present invention is directed to a blank for a returnable envelope and in which two different types of securing means or adhesives are employed, but all of which are applied to the same face of the blank. Certain of the adhesive materials are of the releasable type whereby they may be employed to hold the envelope closed for its first mailing, but which are readily separable so that the envelope may be opened without tearing and the blank may then be reversed and folded in the opposite direction whereupon permanent adhesive means hold the envelope securely closed for a return or second mailing.

DESCRIPTION OF THE PREFERRED EMBODIMENT

Figure 1:
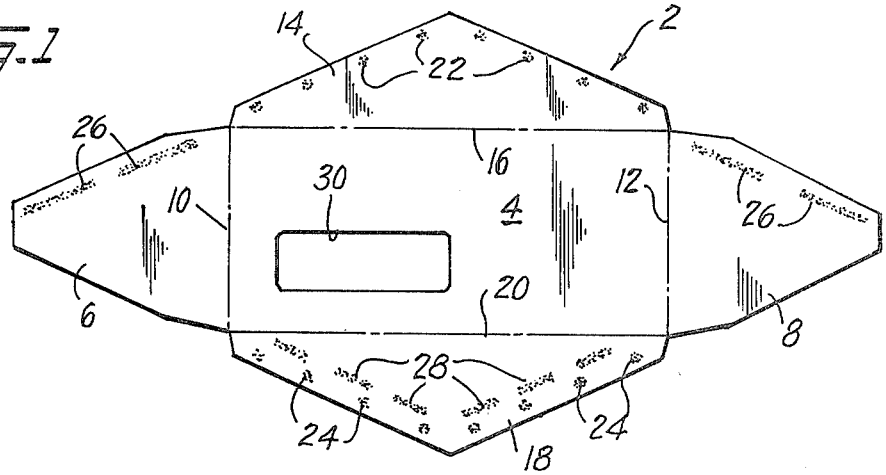
FIG. 1 shows an envelope blank with the different adhesive areas thereon.

FIG. 1 shows a blank 2 of sheet material such as paper or the like for forming the envelope of the present invention. The blank comprises a rectangular main panel portion 4 to the ends of which end flaps 6 and 8 are foldably joined along fold or score lines 10 and 12. The upper edge of the main panel has a first flap 14 foldably attached thereto along fold or score line 16, and the bottom edge of the main panel has the second flap 18 foldably joined thereto along the fold line 20.

Numerals 22 denote spots of releasable adhesive arranged along the outer edge of the first flap 14 and numerals 24 denote spots or dots of releasable adhesive material arranged along the outer edge portion of second flap 18. The releasable adhesive of the dots 22 and 24 may be of any well-known type, known in the trade as release gum, and which may be adhered to another sheet, but readily separated therefrom without tearing the paper. Such releasable adhesive may either be dry and activated by moisture or it may be of the pressure-sensitive type. In any event, once it has been used and separated, it no longer has adhesive properties.

Along the upper edge portions of the end flaps 6 and 8 are areas of moisture-activatable adhesive 26. Also, along the outer edge portions of the second flap 18 is a series of spots of moisture-activatable adhesive 28. The moisture-activatable adhesives referred to above are preferably of the type that are normally dry and will not stick to an adjacent sheet until they are later moistened, adhered and dryed to form a permanent bond between the sheets. Although such a permanent bond is not essential, it is preferred. On the second flap 18, the rows of adhesive materials 24 and 28 are shown as two adjacent rows. However, such an arrangement is not essential. The areas 28 could be arranged between the dots 24 if desired and in the same row.

As shown, the main panel 4 is provided with a window opening 30 therethrough which is more or less conventional in business envelopes of many types. While shown in the drawings and probably preferable for most applications, the window 30 is not an essential feature of the present invention. The main panel 4 could be solid throughout its area and provided with printed addresses on the appropriate sides.

It is to be pointd out that the releasable adhesive dots 22 are preferably of the type requiring moistening for activation, although after adhesion they are readily separable without tearing the paper.

Figure 2:
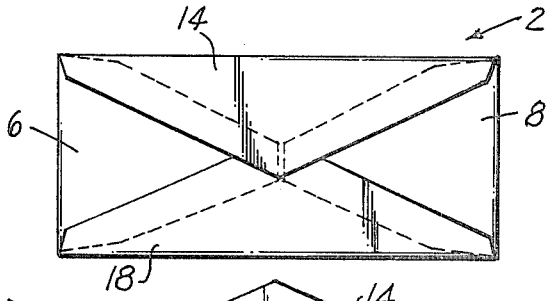
FIG. 2 is a view of the envelope blank of FIG. 1 when folded and releasably closed for its first mailing.

FIG. 2 shows the envelope as folded and sealed for its first mailing. As shown in this figure, the end flaps 6 and 8 were first folded to overlie the main panel 4 and the second flap 18 was then folded upwardly to overlie at least the lower edges of the end flaps 6 and 8. As shown by dotted lines in FIG. 2, the lower edges of the end flaps 6 and 8 and the upper edge portions of the second flap 18 ar superimposed to the extent of the width of the two rows of adhesive 24 and 28 on the second flap 18. This folding and the previous or later insertion of an enclosure could be accomplished by automatic machinery and at which time the preferably pressure-sensitive adhesive dots 24 of flap 18 will temporarily adhere to the lower edge portions of the flaps 6 and 8, thus forming an envelope. If the insertion has not been previously placed in the envelope, it can now then be placed therein and the top or first flap 14 folded downwardly to the position shown, but only after activating the realeasable adhesive dots 22.

In the manufacture of these envelopes and blanks by automatic machinery, it is conventional to fold the end flaps inwardly and the bottom flap upwardly, then to fold the top flap downwardly for packaging the envelopes in a suitable container. The adhesive dots 24 on the second flap, being of the pressure-sensitive type, will readily adhere to the end flaps 6 and 8 and thus hold the envelope in its form. However, folding of the top flap 14 downwardly at this time should not result in adhesively holding the same in the closed position. Thus, it is preferable that the dots 22 thereon be of the moisture-activatable type so that the flap will be readily openable for the later insertion of a mailing piece. Also, as shown in FIG. 2, the lateral dimensions of the flaps 14 and 18 are such that their points or central portions overlap. The adhesive dots 22 may be arranged to engage both the end flaps 6 and 8 and the tip portion of the flap 18 or they may be omitted from the area overlying the flap 18.

Figure 3:
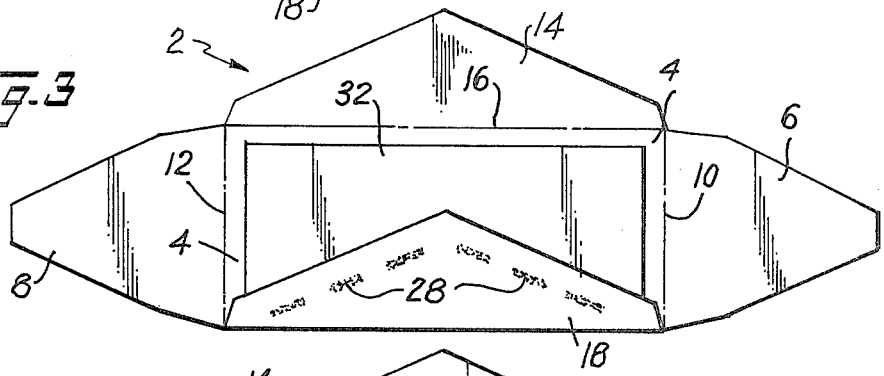
FIG. 3 is a view of the reversed and partially folded blank of FIG. 1 as it is to be folded for the second or return mailing.
Figure 4:
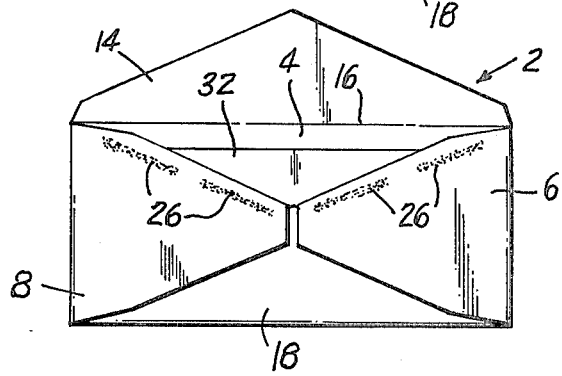
FIG. 4 is a view similar to FIG. 3, but showing a further step in forming the envelope for return mailing.

When the closed envelope of FIG. 2 and its contents are received by the addressee, he may then grasp the tip of the flap 14 and lift the same from the envelope, thus severing the releasable adhesive dots 22 and retrieve the contents of the envelope. He may then prepare his return mailing insertion, such as, the statement from the company and his check in payment thereof and then lift the lower flap 18 to sever the releasable-adhesive dots 24, and thus open the blank up to the position shown in FIG. 1. At this time, he would turn the blank over to the position of FIG. 3 wherein all of the adhesive areas are on the bottom or underside of the blank. He then folds the second flap 18 upwardly as shown in FIG. 3. The areas 28 of moisture-activatable adhesive are then moistened and the end flaps 6 and 8 folded inwardly to form the open envelope shown in FIG. 4. It is to be understood that the moistening of the areas 28 and the subsequent engagement with the flaps 6 and 8 will result with a more or less permanent adhesion between those parts to thus provide a secure envelope for return of a check or payments to the original sender. FIGS. 3 and 4 show schematically at 32 the return enclosure which may be one or more items such as the stub of the sender's bill or statement and the customer's check.

After the envelope is in the condition shown in FIG. 4, the upper or first flap 14 may be folded downwardly after moistening the moisture-activatable adhesive areas of 26 and upon contacting the same the envelope will be permanently sealed in the conventional manner and constitute a secure envelope not subject to ready or easy opening.

While a single specific form of the invention has been shown and described herein, the same is merely illustrative of the principals involved and other forms may be resorted to. For example, the end flaps and the first and second side flaps may be of different shape from that illustrated in the drawings. The only essential element being that when folded to envelope form, the bottom flap shall overlap or overlie at least a portion of the end flaps, the same being true of the upper flap 14.

I claim:

1. A blank for forming a reversible and returnable envelope comprising:

a sheet of material defining a main panel of generally rectangular shape;

an end flap foldably joined to each end of said main panel;

a first flap foldably joined to one side edge of said main panel;

a second flap foldably joined to the other side edge of said main panel;

the outer edge portions of said first flap having means thereon, on one face of said blank for releasably securing said first flap and its outer edge portion to at least one of the other flaps;

the outer edge portion of said second flap having selectably usable means thereon, positioned adjacent each other on said one face of said blank for securing said second flap to at least one of said other flaps at least one of said selectively usable means being readily releasable for releasably securing said second flap and its outer edge portion to said one of said outer flaps; and said end flaps being provided with moisture activatable adhesive means on said one face of said blank.

2. A blank as defined in claim 1 wherein said means for releasably securing said first and second flaps to other flaps comprises a releasable adhesive.

3. A blank as defined in claim 1 wherein said means on the outer edge portion of said second flap comprise discrete areas of adhesive certain of which are of a pressure-sensitive releasable adhesive and others of which are a moisture activatable adhesive.

4. A blank as defined in claim 1 wherein said main panel is provided with a window therein.

5. A blank as defined in claim 1 wherein said flaps are so configured and dimensioned that, when all of said flaps are folded to overlie the same face of said main panel, said outer edge portions of said second flap and lower edge portions of said end flaps are superimposed and said outer edge portion of said first flap and the upper edge portions to said end flaps are superimposed; said moisture activatable adhesive on said end flaps being on said upper edge portions thereof.

6. A blank as defined in claim 1 wherein said means on said outer edge portion of said first flap are positioned thereon to engage said end flaps, and said selectively usable means on said second flap are positioned to engage said end flaps, when all said flaps are folded to overlie the same face of said main panel.

7. A blank as defined in claim 6 wherein at least portions of said first and second flaps are superimposed.

* * * * *